US007866310B2

(12) United States Patent
Halmone

(10) Patent No.: US 7,866,310 B2
(45) Date of Patent: Jan. 11, 2011

(54) RAPIDLY REMOVABLE BOLT FOR A PAINTBALL MARKER

(75) Inventor: Fabrice N. V. Halmone, Ville la Grand (FR)

(73) Assignee: Kingman International Corporation, Baldwin Park, CA (US)

( * ) Notice: Subject to any disclaimer, the term of this patent is extended or adjusted under 35 U.S.C. 154(b) by 163 days.

(21) Appl. No.: 12/397,793

(22) Filed: Mar. 4, 2009

(65) Prior Publication Data

US 2010/0224179 A1 Sep. 9, 2010

(51) Int. Cl.
*F41B 11/00* (2006.01)

(52) U.S. Cl. ..... 124/73; 124/75; 124/76; 124/77

(58) Field of Classification Search ..... 124/71–77
See application file for complete search history.

(56) References Cited

U.S. PATENT DOCUMENTS 6,142,136 A * 11/2000 Velasco ..... 124/71
6,553,983 B1 * 4/2003 Li ..... 124/73
6,868,846 B2 * 3/2005 Jzn ..... 124/74
7,490,598 B2 * 2/2009 Rice ..... 124/77
7,624,726 B2 * 12/2009 Wood ..... 124/73
2005/0133014 A1 * 6/2005 Jones ..... 124/73
2009/0114202 A1 * 5/2009 Dobbins ..... 124/76

* cited by examiner

*Primary Examiner*—Troy Chambers
(74) *Attorney, Agent, or Firm*—Blakely, Sokoloff, Taylor & Zafman, LLP

(57) ABSTRACT

A pneumatic gun with easily removable bolt. A bolt is coupled to a bolt pin to be introduced into the rear of a receiver of the pneumatic gun. The striker defines a notch to receive the bolt pin the notch is open ended towards the rear of the gun. A cap is coupled to the striker so that it can rotate between an open orientation and a closed orientation. In the open orientation, the cap defines a slot that aligns with the notch of the striker to permit the bolt pin to enter the notch and the closed orientation of the cap captures the striker within the notch so that the striker and bolt move as a unit.

10 Claims, 3 Drawing Sheets

OPEN POSITION

CLOSE POSITION

RAPIDLY REMOVABLE BOLT FOR A PAINTBALL MARKER

BACKGROUND

1. Field of the Invention

Embodiments of the invention relate to pneumatic guns. More specifically, embodiments of the invention relate to pneumatic guns having easily releasable bolts to permit more efficient maintenance.

2. Background

Paintball guns, also referred to interchangably as "paintball markers," regularly require maintenance and cleaning. When paintballs are loaded into the gun, breakage occasionally occurs and necessitates cleaning of the bolt chamber. To clean the bolt chamber, the bolt must be removed. At times it is necessary and desirable to clean the bolt chamber during competition. A broken paintball can cause the gun to malfunction or function with reduced accuracy. Manufacturers have historically tried to minimize the number of components needed to be removed to keep the operation as fast as possible.

In existing paintball guns having a striker, the bolt is connected to the striker by what is most commonly referred to as a bolt pin. The bolt pin is round and passes through a bore in the bolt and enters a circular bore in the striker. This causes the bolt and the striker to move together responsive to trigger pulls. In this manner, as the striker moves forward to release a gas charge, the bolt moves forward and pushes the paintball into the firing position within the barrel.

Regular bolt pins are typically accessible from the top of the gun. When the bolt pin is removed through the opening at the top, the bolt is freed from the striker and can be removed through the rear of the gun to permit the bolt chamber to be cleaned. For guns that have no top opening, it is not possible to remove the bolt pin in this manner. This results in a considerably more complicated maintenance and cleaning operation for the gun internals as more parts must be removed to remove the bolt to expose the bolt chamber for cleaning.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
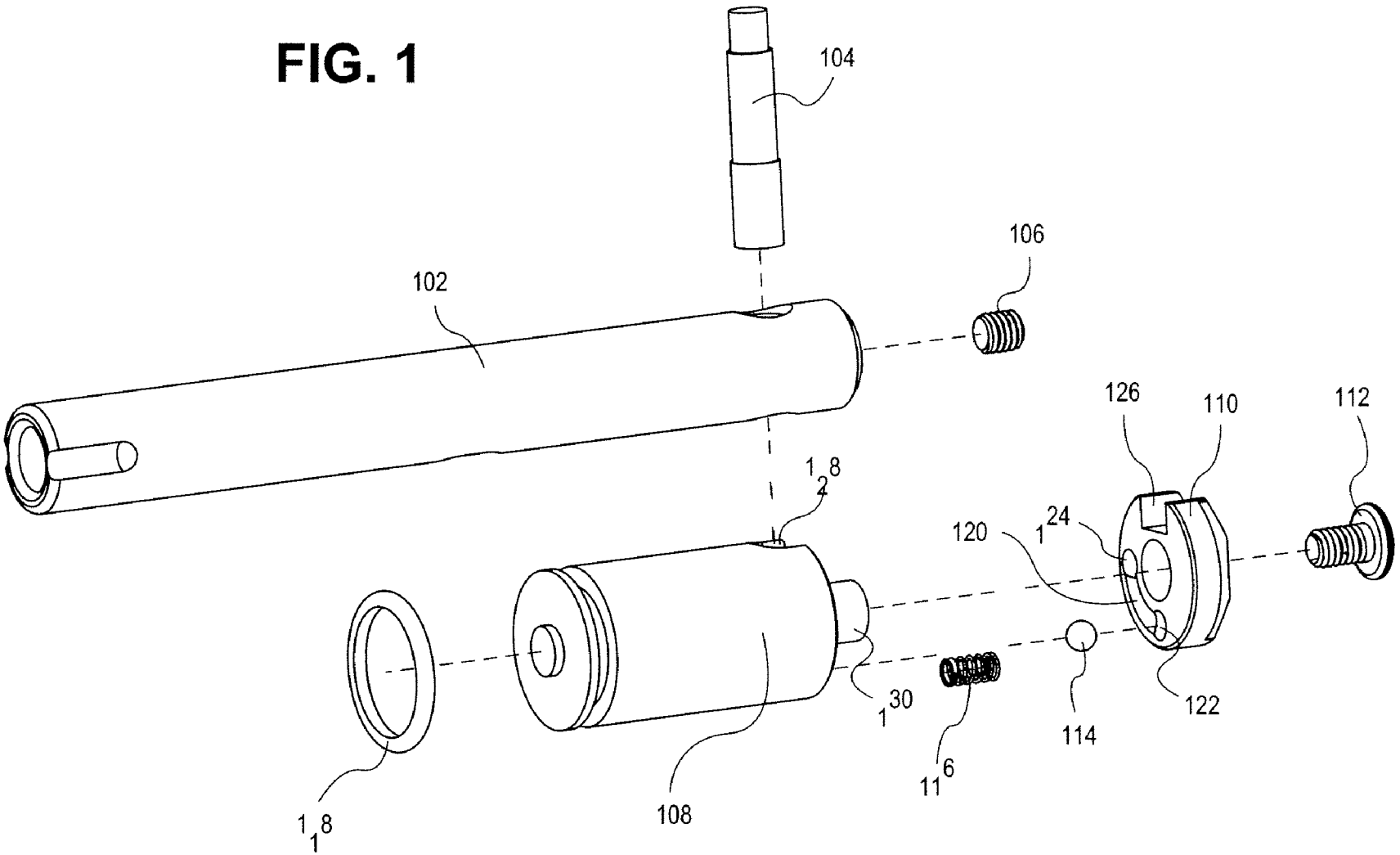
FIG. 1 is an exploded view of the bolt assembly of one embodiment of the invention.

FIG. 1 is an exploded view of the bolt assembly of one embodiment of the invention. A bolt 102 has a bore to receive a bolt pin 104, which is fixed thereto by screw 106. As a result, a tools for example, an Allen wrench, is required to remove the bolt pin 104 from the bolt 102. Bolt 102 in use is installed in longitudinal alignment with the barrel of the paintball gun and reciprocates back and forth pushing paintballs into a firing position. This reciprocation is caused by the interconnection with the striker 108.

An O-ring 118 engages the striker to provide a seal with the gas charge chamber during use. Striker 108 defines a notch 124 to receive bolt pin 104. Notch 128 is semi-circular with an open end positioned towards the rear of the gun (distal to the barrel) when striker 108 is installed within the receiver. It is not strictly critical that notch 128 be semi-circular, only that it closely match the shape of bolt pin 104 and that the opening be sufficient to allow the bolt pin 104 to move laterally (rearwardly) out of the opening. Striker 108 also has a rearwardly projection stem 130. A cap 110 may be inserted over the stem 130 and be rotatable around the stem. A cap 110 may define a slot 126 that when aligned with then notch 128, frees the bolt pin to move rearwardly and thereby allows the bolt and bolt pin assembly to be removed as a unit from the gun. In a second orientation, where the slot 126 is not aligned with the notch 128, the cap 110 captures the bolt pin 104 within the notch 128 such that the bolt 102 and striker 108 reciprocate together.

In one embodiment, to ensure that the cap 110 does not shift between the open orientation and the closed orientation during use, a track 120 is defined in a cap in which a ball bearing 114 resides. In the shown embodiment the track 120 permit a ninety degree rotation between the open and closed orientation, greater or lesser rotational arcs are within the scope and contemplation of embodiments of the invention. First and second depressions 124 and 122 are provided at two ends of track 120. The depressions 124 and 122 are sized to receive and hold the ball bearing 114 effectively providing a detent that maintains the orientation of the cap 110 when the ball bearing 114 resides in a respective depression 122,124.

A biasing member such as spring 116 may be used to apply pressure to the ball bearing to hold it within the depression 122, 124 as desired. In some embodiments, only the depression 124 holding the cap in a closed position may be provided. In some embodiments, the track may be eliminated depressions 122 and 124 may be replaced by magnets having corresponding opposite polarity magnets residing on the striker 108 to provide the desired bias to maintain the open or closed orientation.

In either case, relatively little force is required for a user to transition the cap 110 between the open and closed orientations by hand. The user need merely overcome the spring force or magnetic force and rotate the cap from the closed position to the open position to free the bolt. Striker screw 112 engages the stem 130 of striker to retain the cap on the striker. Because cap is able to rotate about the stem 130 independent of the striker screw 112, hand manipulation of the cap between open and closed position, rather than requiring tools is possible.

Figure 2:
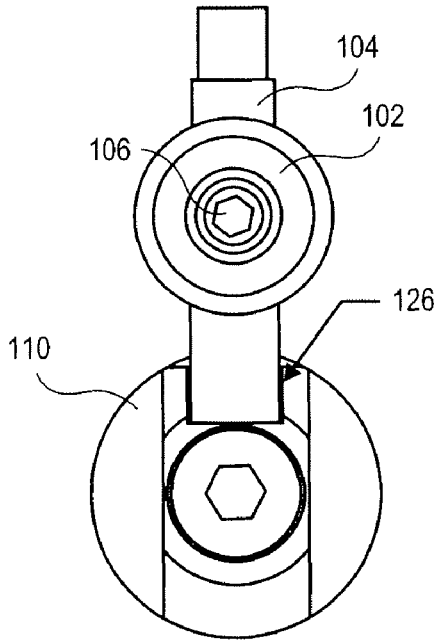
FIG. 2 is a schematic rear view of the bolt assembly of one embodiment of the invention.

FIG. 2 is a schematic rear view of the bolt assembly of one embodiment of the invention. Bolt pin 104 is fixably coupled to bolt 102 by screw 106. Bolt pin 104 resides in the notch in a striker. Striker cap 110 provides slot 126 which frees the bolt pin to translate rearwardly to allow the bolt to be removed from the gun when aligned with the notch as shown. Striker screw 112 attaches the cap 110 to the striker.

Figure 3:
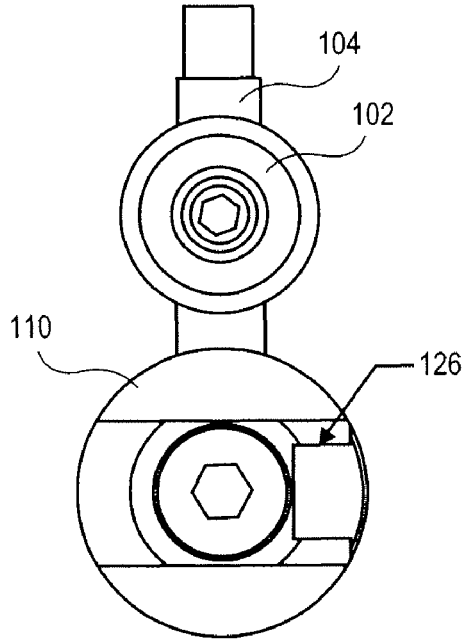
FIG. 3 is a schematic view of the bolt assembly of one embodiment of the invention in a closed orientation.

FIG. 3 is a schematic view of the bolt assembly of one embodiment of the invention in a closed orientation. The slot 126 and cap 110 is rotated 90 degrees so that bolt pin 104 is captured within the notch of the striker and the bolt and bolt pin assembly cannot translate rearwardly, but rather is required to reciprocate back and forth with the striker as a unit.

Figure 4:
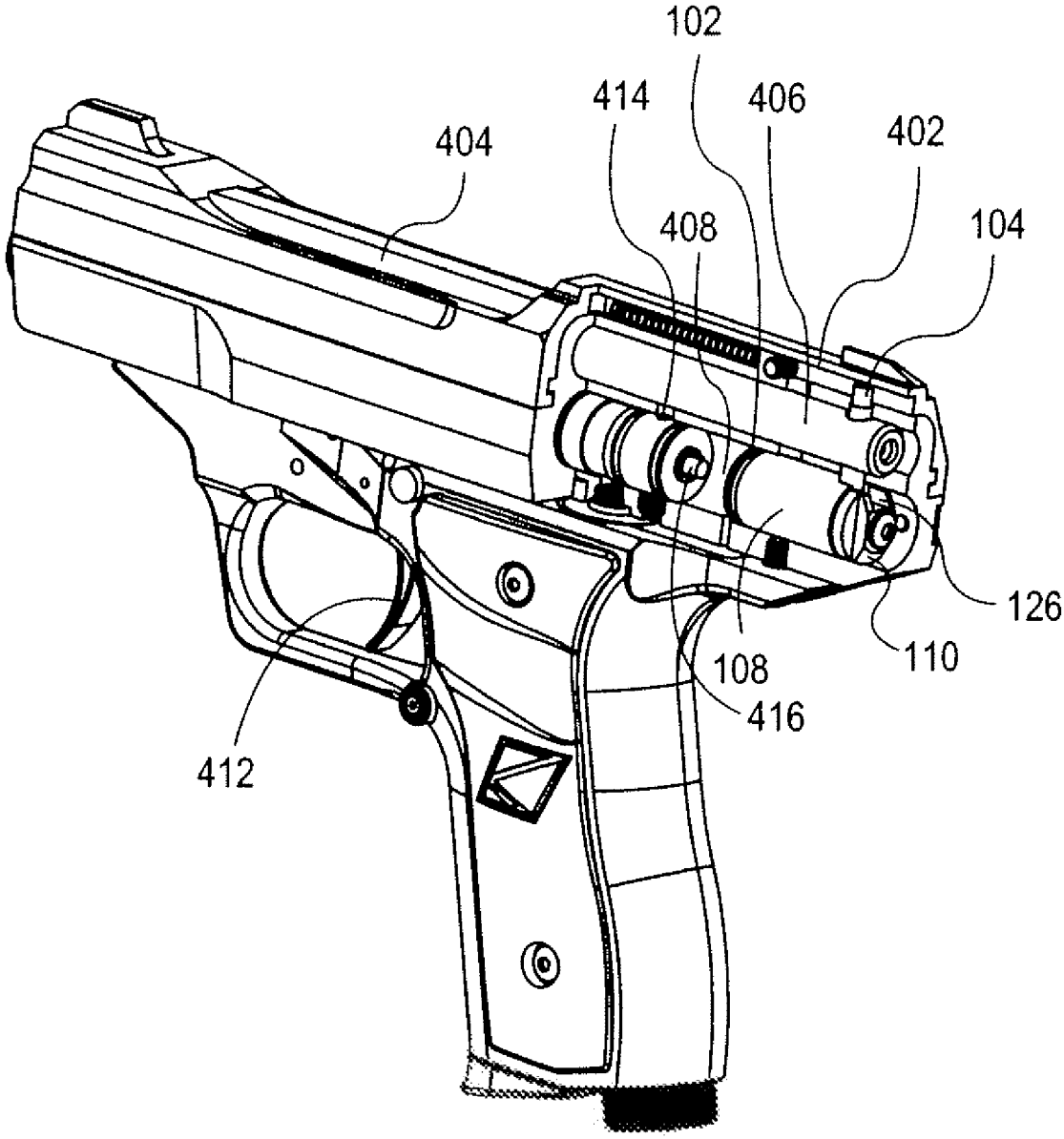
FIG. 4 is a rear perspective cut away view of the pneumatic gun of one embodiment of the invention.

FIG. 4 is a rear perspective cut away view of the pneumatic gun of one embodiment of the invention. Receiver 402 defines a bolt chamber 406 to retain bolt 102 and bolt pin 104. Bolt chamber 406 has a rearward egress to permit removal of the bolt 102. In the shown embodiment, receiver 402 defines no top opening to permit access to the bolt pin 104. As previously described with respect to FIGS. 1-3, bolt pin 104 and bolt 102 are coupled together as a unitary assembly. Bolt chamber 406 (and therefore bolt 102) is longitudinally aligned with barrel 404 of the pneumatic gun.

Striker 108 is captured within striker chamber 408, such that it moves longitudinally backward and forward responsive to pulls of trigger 412. Striker 108 does not rotate within striker chamber 408. Cap 110 is coupled to striker 108 and can rotate to align the slot 126 to either capture the bolt pin 104 or permit rearward egress of the bolt 102 and bolt pin 104 assembly. This unitary removal without tools makes cleaning and maintenance of the bolt chamber 406 a simple matter.

Responsive to actuation of trigger 412, striker 108 moves forward striking impact member 416 causing the release of a gas charge through duct 414 and into bolt 102. Bolt 102 has a hollow portion in fluid communication with barrel 404 such that the gas charge released into the bolt propels, e.g., a paintball in a firing position from the barrel 404. A portion of the gas charge is released into the striker chamber 408 and pushes the striker 108 (and therefore the bolt 102) back to a cocked position.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A pneumatic gun comprising:

a bolt;

a bolt pin coupled to the bolt;

a striker defining a notch to receive the bolt pin such that when the bolt pin is capture in the notch the bolt and striker move as a unit, the notch having an open end distal to the barrel; and a cap rotatably coupled to the striker to move between a closed orientation and an open orientation, the cap defining a slot that in the open orientation aligns with the open end of the notch to free the bolt pin to permit removal of the bolt from the gun.

2. The pneumatic gun of claim 1 further comprising:

a bias means to hold the cap in either the open orientation or the closed orientation.

3. The pneumatic gun of claim 2 wherein the bias means comprises one of:

a magnet or a spring.

4. The pneumatic gun of claim 1 wherein the cap defines an arcuate track having a first depression at a first end and a second depression at a second end.

5. The pneumatic gun of claim 4 further comprising:

a ball bearing to reside in and move along the track;

a spring engaging the ball bearing and biasing it into the first depression or the second depression to retain the cap in an open orientation or a closed orientation respectively.

6. The pneumatic gun of claim 1 further comprising:

a screw coupling the bolt pin to the bolt.

7. The pneumatic gun of claim 1 further comprising:

a striker screw engaging the striker to retain the cap on the striker.

8. A pneumatic gun comprising:

a barrel;

a bolt;

a bolt pin coupled to the bolt;

a receiver defining a bolt chamber aligned with the barrel, the bolt chamber having no top opening for the bolt pin;

a striker defining a notch to receive the bolt pin, the notch having an open end distal to the barrel; and a cap rotatably coupled to the striker to move between a closed orientation and an open orientation, the cap defining a slot that in the open orientation aligns with the open end of the notch to free the bolt pin to permit removal of the bolt from the gun and in the closed orientation captures the bolt pin within the notch so that the bolt and striker move as a unit.

9. The pneumatic gun of claim 8 further comprising:

a bias member to bias the cap into a locked position in the closed orientation.

10. The pneumatic gun of claim 8 where in the cap is hand rotatable between the open and closed orientation.

* * * * *